United States Patent [19]

Mustoe, Jr.

[11] 3,978,576

[45] Sept. 7, 1976

[54] NAIL EXTRACTOR

[75] Inventor: Jack Mustoe, Jr., Cumbernauld, Scotland

[73] Assignee: Glentore Timber Products Limited, Cumbernauld, Scotland

[22] Filed: Apr. 21, 1975

[21] Appl. No.: 569,668

[30] Foreign Application Priority Data

Aug. 9, 1974 United Kingdom ..... 35378/74

[52] U.S. Cl. ..... 254/18

[51] Int. Cl.[2] ..... B66F 15/00

[58] Field of Search ..... 254/18; 29/252

[56] References Cited

UNITED STATES PATENTS

| | | | |
|---|---|---|---|
| 1,771,712 | 7/1930 | Jimerson | 254/18 |
| 2,709,570 | 5/1955 | Henry | 254/18 |
| 2,735,649 | 2/1956 | Swallert | 254/18 |
| 2,797,889 | 7/1957 | Talboys | 254/18 |
| 2,826,446 | 3/1958 | Hursh | 254/18 |
| 2,846,187 | 8/1958 | Sublett et al. | 254/18 |

*Primary Examiner*—Al Lawrence Smith
*Assistant Examiner*—Robert C. Watson
*Attorney, Agent, or Firm*—Lowe, King, Price & Markva

[57] ABSTRACT

An extractor for nails comprising a cylinder, a piston reciprocable in said cylinder under the influence of fluid pressure, a pair of gripping jaws located externally of said cylinder, at least one of which jaws is movable between nail gripping and non-gripping positions as a result of mechanical interaction between said piston and said movable jaw or jaws upon displacement of said piston towards and away from said jaws under the action of fluid pressure.

17 Claims, 7 Drawing Figures

NAIL EXTRACTOR

This invention relates to an extractor for nails, pins, bolts, staples etc., all here referred to generally as "nails", adapted to remove nails from timber, concrete, synthetic plastics, one example of the extensive use of such an extractor being in the opening of timber packing cases.

A well known hand operated extractor comprising a lever arm of about 2′ length, terminating in a fixed jaw, and opposite this a pivotable jaw, the fixed jaw being forced manually into e.g. the timber in an attempt to locate it underneath the head of the nail to be removed, and once this is achieved displacement of the lever closes the movable jaw towards the fixed jaw to complete gripping of the nail head for extracting to take place by continued displacement. Such a tool makes nail removal a laborious and time consuming operation but, in the case of timber packing cases, it is an essential operation, if the present trend of re-using packing cases, in view of timber costs, is to be conformed with, to leave the packing cases undamaged, after opening, and hence re-usable.

The object of the present invention is to provide a powered extractor for nails capable of extracting nails at a much higher rate than heretofore possible with the hand operated tools which is less tiring to operate for the user.

According to the present invention, an extractor for nails comprises a cylinder, a piston reciprocable in the cylinder under the influence of fluid pressure, a pair of gripping jaws located externally of the cylinder, at least one of which jaws is movable between nail gripping and non-gripping positions as a result of mechanical interaction between the piston and the movable jaw or jaws upon displacement of the piston towards and away from the jaws under the action of fluid pressure.

Thus, in use, with the piston remote from the jaws, the latter are in their open, non-gripping position and are placed around the head of a nail proper to be extracted. Fluid pressure is then admitted to the cylinder to force the piston towards the jaws until mechanical means associated with the piston strike the movable jaw or jaws to urge the latter towards the fixed jaw thereby gripping the nail head. Fluid pressure can then be used to withdraw the nail. Obviously the distance of the gripping jaws from the cylinder and the stroke of the piston must be related so that the extractor is effective for the maximum nail length likely to be encountered.

The cylinder and piston may be double acting or alternatively, if single acting, a second cylinder and piston unit may be provided.

Preferably, the fluid used to power the extractor according to the invention is air, for air compressors are readily available, whereas if hydraulic fluid were employed the user would probably have to purchase an hydraulic pump.

Another feature of the invention is to have the gripping jaws rotatable by power means e.g. an electric motor, an hydraulic motor, or an air rotor, so that the jaws may, if required cut a circular groove around a nail head, to ease gripping of the latter.

Thus, one embodiment of the present invention has the gripping jaws located at one end of a centre shaft co-axial with the longitudinal axis of the cylinder, passing through an adjacent end plate thereof and secured to a remote end plate thereof, the piston being provided with a sleeve co-axially surrounding the centre shaft, the sleeve projecting from the cylinder at any position of the piston, the lower end of the sleeve being adapted to engage over the gripping jaws to urge the movable jaw or jaws into gripping position. Preferably both gripping jaws are movable, being located on pivot pins carried by the centre shaft and urged away from one another by a common compression spring. The top end plate of the cylinder may be bored to provide a pressure fluid supply to the upper side of the piston, while a bottom end plate may be provided with one or more holes to connect the annulus side of the piston to atmosphere. The piston may include a return spring. To the top end plate may be attached a handle, with a three-way valve screwed into a tapped hole in that plate.

According to another embodiment of the present invention, a tubular valve element extends between top and bottom end plates of the cylinder, the element being provided with bores to convey or exhaust compressed air, via bores in the top and bottom end plates, to both the top side and annulus side of the piston, a valve member being slidably mounted on the tubular valve element, and preferably maintained in a neutral position by being located between a pair of compression springs.

According to yet another embodiment of the present invention, the extractor comprises two piston and cylinder devices the first device being to effect a nail head gripping action and the second device being to effect extraction of a gripped nail. The cylinder of the first device may be provided with a free piston having a striking surface, while that of the second device is provided with a piston and a piston rod projecting beyond the cylinder and terminating in a pusher foot.

The invention will now be described in greater detail, by way of example, with reference to the accompanying drawings, in which:

FIG. 1 is an axial sectional view through a first embodiment of an extractor according to the invention;

FIG. 2 corresponds to FIG. 1 but shows an extractor part way through the nail extraction operation;

In all embodiments, like reference numerals are used for like component parts.

Figure 1:
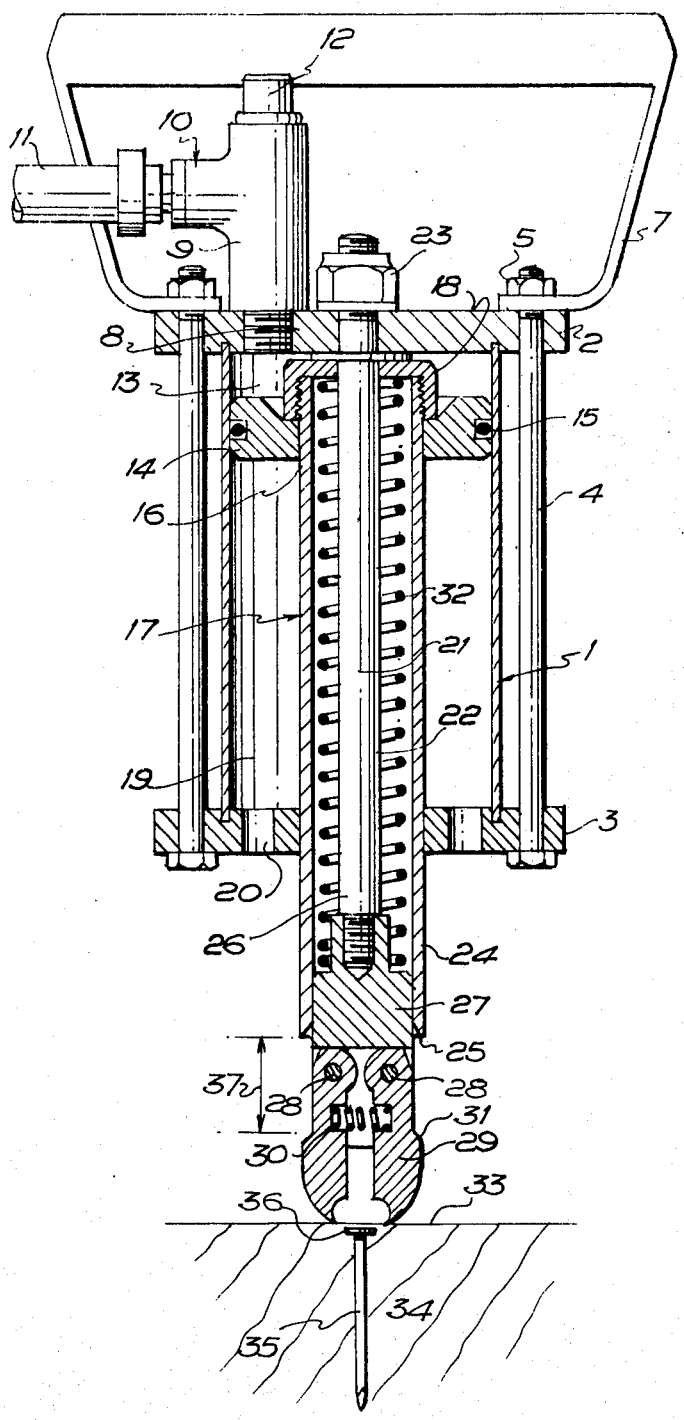
Figure 2:
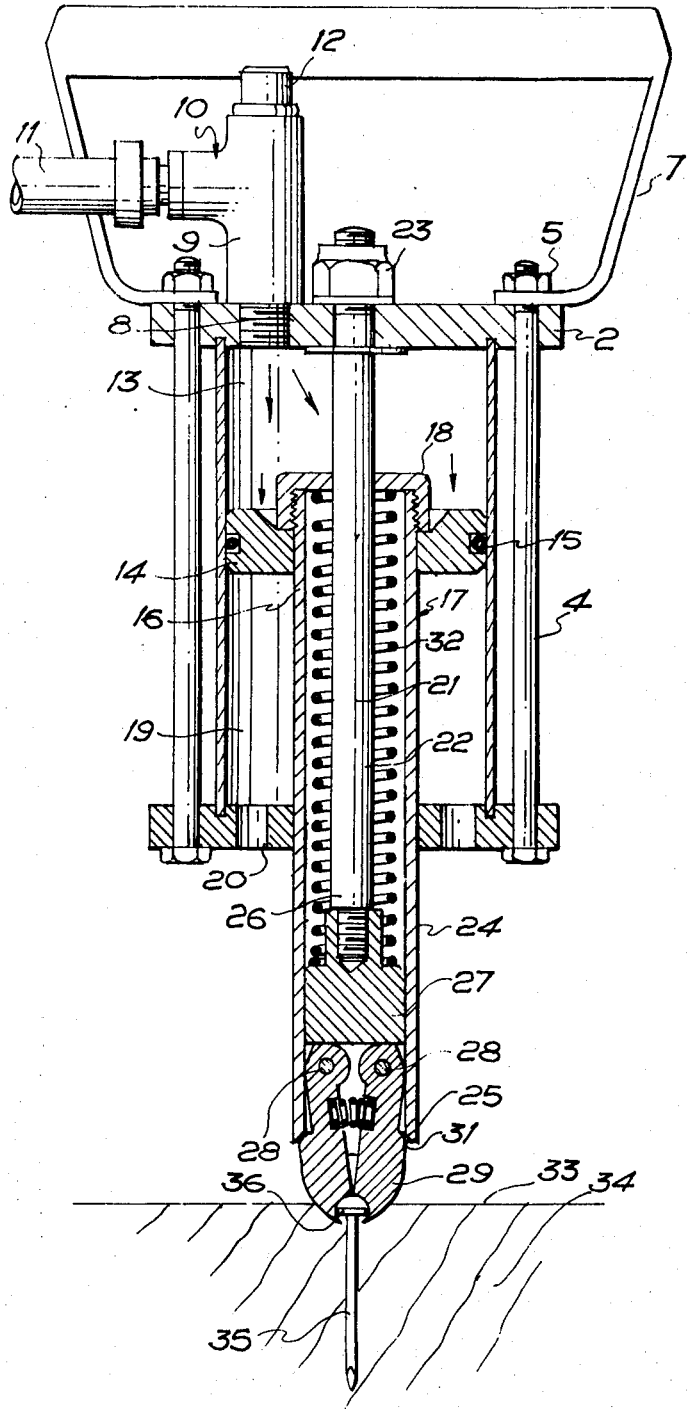

In the embodiment of FIGS. 1 and 2, the extractor can be seen to consist of a cylinder 1, closed by a top end plate 2 and a bottom end plate 3, the end plates being secured together and to the cylinder 1 by a plurality of tie bolts 4, nuts 5 of which serve additionally to secure a handle 7 to the top end plate 2. The latter is also provided with a tapped hole 8 to receive a body member 9 of a three-way valve 10, the latter carrying an air pressure supply conduit 11, an exhaust outlet (not shown) and having an operating button 12, under the influence of which air is admitted or exhausted via the tapped hole 8 from a zone 13 of the cylinder 1 above a piston 14 reciprocable within the cylinder 1. The piston 14 is provided with an O-ring seal 15 and is screwed on to an upper end 16 of a push sleeve 17, and is locked thereon by a sleeve nut 18. An annulus zone 19 of the cylinder 1 communicates with the atmosphere via a plurality of holes 20 in the bottom end plate 3.

Co-axial with the longitudinal axis 21 of the cylinder 1 there is located a centre shaft 22, which passes through the top end plate 2, and carries a top nut 23 beyond the top end plate 2. The sleeve 17 has a lower end 24 projecting beyond the cylinder 1 by passing through an aperture in the bottom end plate 3, to terminate in inwardly chamfered surfaces 25. To a lower end 26 of the centre shaft 22 is screwed a jaw holder 27 which carries a pair of pins 28, with their axis at right angles to the longitudinal axis 21, on each of which pins 28 is pivotally secured one of a pair of gripping jaws 29 normally urged apart by a common compression spring 30, each jaw 29 being provided with a shaped periphery 31 to co-operate, in use, with the surfaces 25 of the sleeve 17. Within the sleeve 17 and surrounding the centre shaft 22 is a re-setting compression spring 32 extending between the sleeve nut 18 and the jaw holder 27.

FIG. 1 shows the extractor with the gripping jaws 29 located on a surface 33 of a timber component 34 containing a nail proper 35 with a head 36, the longitudinal axis of the nail being made to correspond generally with the longitudinal axis 21 of the cylinder 1. In this position the extractor is ready for the valve operating button 12 to be depressed, so that there is a free travel distance 37 by which the piston 14 and hence the sleeve 17 may move before the surfaces 25 about the peripheries 31 of the gripping jaws 29. In FIG. 2, the button 12 has just been depressed, admitting compressed air to the zone 13 and correspondingly exhausting air from the annulus zone 19 via the holes 20. When this occurs, the piston 14 and the sleeve 17 are moved away from the top end plate 2, the spring 32 becoming compressed and after the distance 37 has been travelled, the surfaces 25 strike the peripheries 31 to give the gripping jaws 29 components of movement, both outwardly, to bite into the timber surface 33 and inwardly, to engage the nail head 36, and this has just occurred in FIG. 2. Continued depression of the button 12 forces the piston 14 downwardly and hence the sleeve 17 carried by the piston, until the surfaces 25 about the timber surface 33, whereupon the piston 14 can move no further and continued admission of the compressed air to the zone 13 causes the piston and in fact all of the extractor with the exception of the sleeve 17 etc. to move away from the timber surface 33 thus beginning extraction of the now gripped nail 35, the button 12 remaining depressed until extraction has been completed. Once extraction has been completed, release of the button connects the zone 13 to the atmosphere, which enables the re-setting spring 32 to exhaust previously compressed air from the zone 13 via the exhaust outlet of the valve 10, atmospheric air being re-admitted to the annulus zone 19 via the holes 20.

Figure 3:
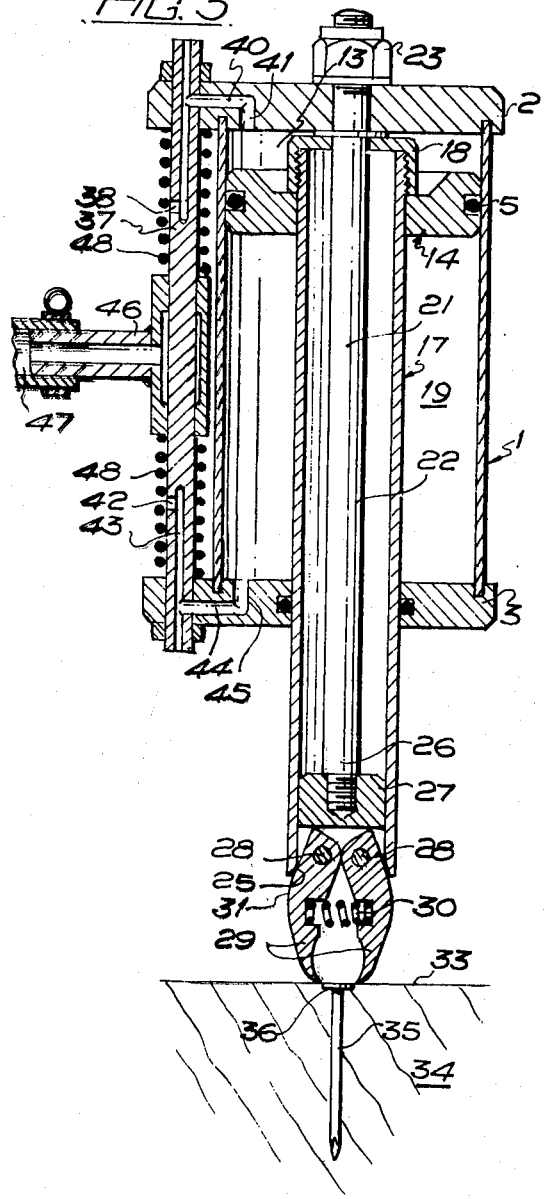
FIG. 3 is an axial sectional view through a second embodiment of an extractor according to the invention.

In the embodiment of FIG. 3, a different valve arrangement is employed to that of the first embodiment and the piston 14 is double acting. Thus between the top end plate 2 and the bottom end plate 3, there extends a tubular valve element 37, provided with bores 38 and 39, to convey or exhaust compressed air, via ports 40 and 41 in the top end plate 2, to or from the zone 13. The valve element 37 is similarly provided with ports 42 and 43, with associated ports 44 and 45 in the bottom end plate 3, to convey or exhaust compressed air to or from the annulus zone 19. Slidable on the tubular valve element 37 is a valve member 46 maintained in a neutral position, where it does not communicate compressed air supplied along conduit 47 to either port 38 or 42, by a pair of compression springs 48. The operating position of FIG. 3 in the nail extraction operation corresponds to that of FIG. 1. From the FIG. 3 position, the valve member 46 is moved manually upwardly to connect the supply of compressed air to the ports 39 and 40 and 41, and hence to the zone 13 to move the piston 14 and hence the sleeve 17 away from the top end plate 2, air in the annulus zone 19 being exhausted by ports 45, 44, 43 and 42, the surfaces 25 again striking the shaped peripheries 31 of the gripping jaws 29, for the remainder of the nail gripping and extraction operation to be carried out as generally described with respect to the first embodiment. Once the nail 35 has been extracted the extractor may be returned to its starting position by manually moving the valve member 46 to supply compressed air, via ports 42, 43, 44 and 45 to the annulus zone 19, air in the zone 13 being exhausted to atmosphere by ports 41, 40, 39, and 38.

Figure 4:
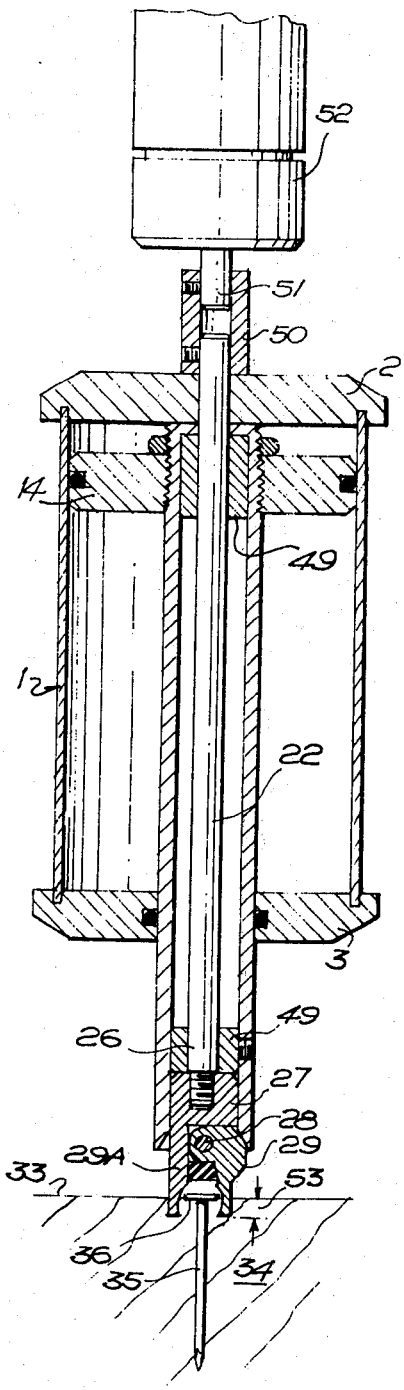
FIG. 4 is an axial sectional view through a third embodiment of an extractor according to the invention.

In the embodiment of FIG. 4, no valve arrangement is shown but this could as desired, be of the type shown in either the first or second embodiments, for the purpose of FIG. 4 is to show the feature of the gripping jaws 29 being rotatable. Thus the centre shaft 22, un-like the two previous embodiments, does not terminate in a top nut 23, but is provided with journal members 49 by which the centre shaft 22 and the jaw holder 27 may be rotatable within the sleeve 17 and also with a coupling sleeve 50 by which the centre shaft 22 is attached to a rotatable output shaft 51 of an air rotor 52. Also in this embodiment, whilst one jaw 29 is located on a pivot pin 28, the other jaw 29 of the pair is not pivotable. Rotation of the centre shaft 22 and hence the gripping jaws 29 and 29A enables the latter to penetrate the timber surfaces 33 to a depth 53 before the gripping action is commenced, in order to ensure gripping of the nail head 36.

Figure 6:
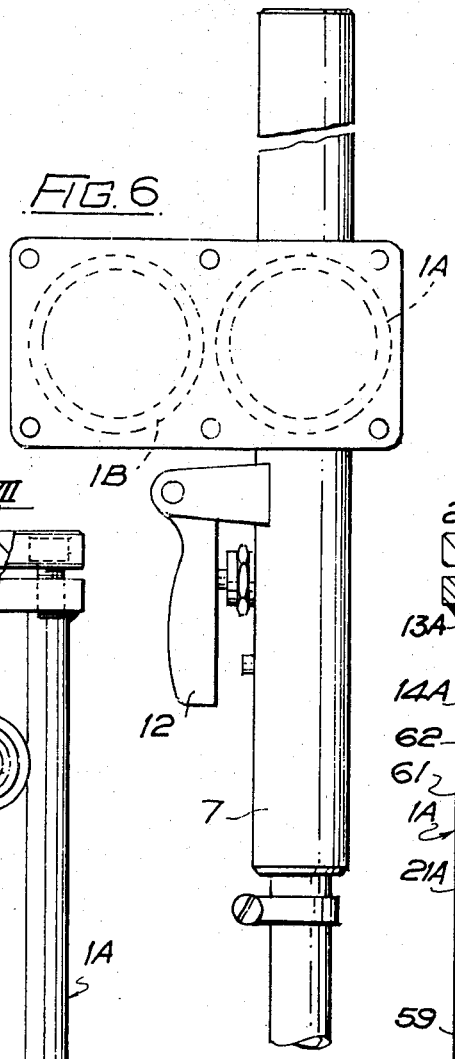
FIG. 6 is a plan view of FIG. 5.
Figure 5:
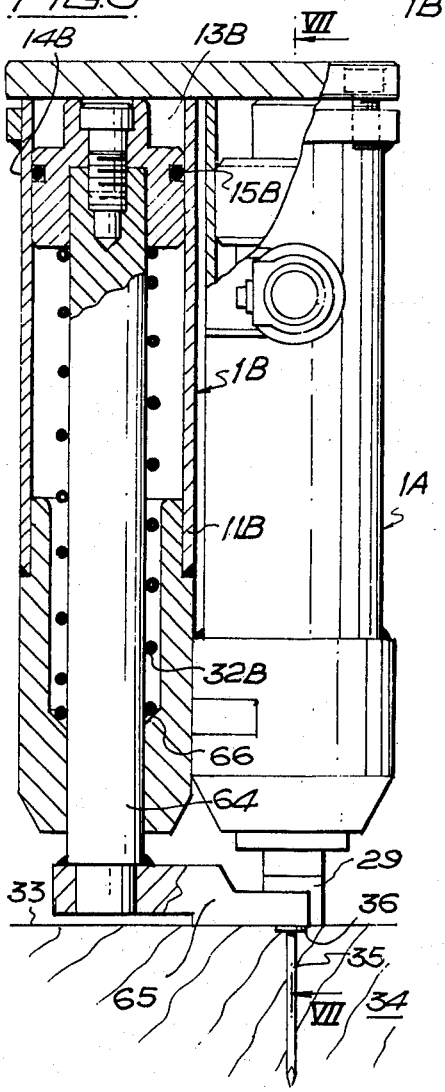
FIG. 5 is a view, partly in section of a fourth embodiment of an extractor according to the invention.
Figure 7:
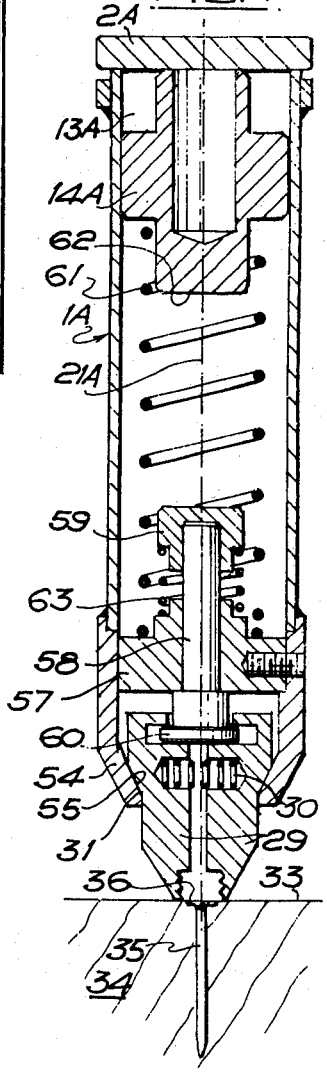
FIG. 7 is a view on the line VII to VII of FIG. 5.

In the embodiment of FIGS. 5 to 7, two piston and cylinder devices are employed, a first cylinder 1A to effect the nail head gripping action, and a second cylinder 1B to effect extraction of a gripped nail. The cylinder 1A terminates in a top end plate 2A and in a lower guide 54, having inwardly directed guide surfaces 55 to co-operate with the peripheries 31 of the gripping jaws 29. Un-like previous embodiments, neither of the jaws 29 is pivotably secured, but rather they are loosely located and urged apart by compression spring 30 within the lower guide 54. The lower guide also carries a bush 57 with a aperture co-axial with the longitudinal axis 21A of the cylinder 1A. In the aperture is located a rod 58, terminating at its upper end in a percussion cap 59 and at its lower end in a foot 60 in contact with and common to, both gripping jaws 29. Within the cylinder 1A is a piston 14A urged away from the bush 57 by a compression spring 61, the piston having a striking surface 62. The rod 58 is urged upwardly by a compression spring 63.

The cylinder 1B is provided with a piston 14B with a piston rod 64 projecting beyond the cylinder 1B and terminating in a pusher foot 65, compression spring 32B surrounding the piston rod 64 and extending between the piston 14B and an abutment surface 66 of the cylinder 1B. The handle 7, extending to opposite sides of the cylinder 1A, carries operating trigger 12 to control compressed air supply to the cylinders 1A and 1B.

The piston 14A may be considered an impact piston as it is employed only to achieve the gripping action on the nail head, while the piston 14B may be considered a pusher piston as it is employed only to achieve extraction from the timber component 34.

In use, with the gripper jaws 29 applied to the surface 33 and surrounding nail head 36, trigger 12 is pressed to admit compressed air to the zone 13A above the piston 14B. The latter overcomes the action of the spring 61 and strikes the percussion cap 59 to displace the latter with respect to the cylinder 1A, overcoming the spring 63. Displacement of the cap 59 results in corresponding displacement of the rod 58, foot 60 and the gripping jaws 29, so that peripheries 31 slide along the conveying guide surfaces 55 to give the jaws both downward and inward movement, compressing also the spring 30, until the gripping jaws 29 bite into the surface 33 and grip the nail head 36. This gripping action is almost instantaneous with actuation of the trigger 12, and continued pressure on the latter admits compressed air to the zone 13B of the cylinder 1B to begin the extraction as cylinder 1B reacts by moving upwardly away from the surface 33, taking with it the attached cylinder 1A and hence extracting the nail 35.

I claim:

1. An extractor for nails comprising a cylinder, an end plate at each end of said cylinder, piston means reciprocable in said cylinder under the influence of fluid pressure, a center shaft disposed coaxially with a longitudinal axis of said cylinder and secured at one end to one of said plates, said shaft passing through the other one of said end plates, and a pair of gripping jaws located at the other end of said shaft, at least one of said jaws being movable between nail gripping and non-gripping positions as a result of mechanical interaction between said piston means and said movable jaws upon displacement of said piston with respect to said jaws under the action of fluid pressure.

2. An extractor as claimed in claim 1, wherein the piston and cylinder is air actuated.

3. An extractor as claimed in claim 1, wherein a movable gripping jaw is pivotally mounted.

4. An extractor as claimed in claim 1, wherein said gripping jaws are rotatable by power means.

5. An extractor as claimed in claim 1, further comprising a sleeve provided on said piston and coaxially surrounding said shaft, said sleeve projecting from said cylinder at any position of said piston, a sleeve lower end being adapted to engage over said gripping jaws to urge said at least one movable jaw into gripping position.

6. An extractor as claimed in claim 5, wherein both said gripping jaws are movable, being located on pivot pins carried by said centre shaft, a common compression spring urging said jaws away from one another.

7. An extractor as claimed in claim 5, wherein a top end plate of said cylinder is bored to provide a pressure fluid supply to an upper side of said piston, while a bottom end plate is provided with one or more holes to connect the annulus side of said piston to atmosphere.

8. An extractor as claimed in claim 7, comprising a piston return spring.

9. An extractor as claimed in claim 7, wherein a three-way valve is screwed into a tapped hole in said top end plate.

10. An extractor as claimed in claim 5, wherein a tubular valve element extends between top and bottom end plates of said cylinder, said valve element being provided with bores to convey or exhaust compressed air, via bores in said top and bottom end plates, to both top side and annulus side of the piston, a valve member being slidably mounted on said tubular valve element.

11. An extractor as claimed in claim 10, wherein said valve member is maintained in a neutral position, where it does not connect compressed air to any port, by being located between a pair of compression springs.

12. An extractor as claimed in claim 1, comprising two piston and cylinder devices, the first device being to effect a nail head gripping action and the second device being to effect extraction of a gripped nail.

13. A nail extractor as claimed in claim 12, wherein said first device has its cylinder terminating in a top end plate and in a lower guide having inwardly directed guide surfaces to co-operate with peripheries of said gripping jaws.

14. An extractor as claimed in claim 13, wherein said gripping jaws are loosely located within said lower guide and urged apart by a compression spring.

15. An extractor as claimed in claim 13, wherein said lower guide also carries a bush with an aperture coaxial with the longitudinal axis of said cylinder, a rod located in said aperture, said rod terminating at its upper end in a percussion cap and at its lower end in a foot in contact with, and common to, both said gripping jaws.

16. An extractor as claimed in claim 12, wherein the said cylinder of said first device is provided with a free piston urged away from said gripping jaws by a compression spring, said piston having a striking surface.

17. An extractor as claimed in claim 12, wherein said cylinder of said second piston and cylinder device is provided with a piston and a piston rod projecting beyond said cylinder and terminating in a pusher foot, a compression spring surrounding said piston rod and extending between said piston and an abutment surface of said cylinder.

* * * * *